US007031627B2

(12) United States Patent
Kobayashi et al.

(10) Patent No.: US 7,031,627 B2
(45) Date of Patent: Apr. 18, 2006

(54) IMAGE FORMING APPARATUS AND METHOD HAVING SPEED CONTROL UNITS FOR SETTING SPEEDS OF A DRIVING UNIT

(75) Inventors: Hidenori Kobayashi, Sunto-gun (JP); Satoshi Hasegawa, Tagata-gun (JP); Yukio Futamata, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/886,613

(22) Filed: Jul. 9, 2004

(65) Prior Publication Data

US 2005/0008380 A1 Jan. 13, 2005

(30) Foreign Application Priority Data

Jul. 11, 2003 (JP) ..... 2003-195782

(51) Int. Cl.
*G03G 15/00* (2006.01)

(52) U.S. Cl. ..... 399/45; 399/46

(58) Field of Classification Search ..... 399/45
See application file for complete search history.

(56) References Cited

U.S. PATENT DOCUMENTS 5,619,746 A * 4/1997 Kubo et al. ..... 399/298

FOREIGN PATENT DOCUMENTS

JP 2000-267474 9/2000

OTHER PUBLICATIONS

U.S. Appl. No. 10/886,638, filed Jul. 9, 2004, Aono et al.

* cited by examiner

*Primary Examiner*—Quana Grainger
(74) *Attorney, Agent, or Firm*—Foley & Lardner LLP

(57) ABSTRACT

An image forming apparatus decreases the speed of moving an optional position in the circumference of a photoconductor, the speed of moving the surface of a transfer belt, and the speed of moving an optional position in the circumference of a roller body of a fixing unit, in a period from a moment when a part of the surface of a transfer belt corresponding to the rear end of the last one of a plurality of overlaid toner images passes a primary transfer position, to a moment when a part of the surface of a transfer belt corresponding to the front end of a toner image held in the transfer belt in the overlaid state reaches the primary transfer position.

7 Claims, 5 Drawing Sheets

IMAGE FORMING APPARATUS AND METHOD HAVING SPEED CONTROL UNITS FOR SETTING SPEEDS OF A DRIVING UNIT

CROSS-REFERENCE TO RELATED APPLICATIONS

This application is based upon and claims the benefit of priority from prior Japanese Patent Application No. 2003-195782, filed Jul. 11, 2003, the entire contents of which are incorporated herein by reference.

BACKGROUND OF THE INVENTION

1. Field of the Invention

The present invention relates to an electrophotographic image forming apparatus which outputs a color image, for example, by fixing to a transfer material toner images in which single-color images corresponding to color-separated color components are overlaid.

2. Description of the Related Art

In an electrophotographic color image forming apparatus, a certain surface potential is given to a photoconductor capable of holding an electrostatic latent image, the photoconductor surface potential according to a background or image part is changed selectively, a toner image is obtained by supplying a developing agent (toner) to that part, and the toner image is transferred to an output medium (transfer material).

Nowadays, user needs have diversified, and there is a demand to output color images with high quality and exact color reproduction to various media including paper sheets of 50–250 g/m$^2$, transparent film sheets, and adhesive stickers.

A color image forming apparatus includes a black developing unit which outputs a black (Bk) image, and a color developing unit which outputs three single-color images of cyan (C), magenta (M) and yellow (Y) thereby forming a color image.

Toner images comprising four colors formed by respective developing units are sequentially overlaid on a photoconductor or transfer material, that is, a sheet of ordinary paper or an OHP sheet, and fixed to the transfer material by a fixing unit.

A method of increasing the fixing temperature or decreasing the fixing speed when fixing a color image comprising multiple toner images overlaid on a transfer material has been proposed to ensure high-quality color reproduction and a high fixing rate even for thick paper sheets and OHP sheets.

For example, Jpn. Pat. Appln. KOKAI Publication No. 2000-267474 proposes an image forming apparatus which can select a first fixing speed and a second fixing speed higher than the first fixing speed, and decreases the speed of a fixing unit to the second speed by releasing pressure contact between an image holding body and an intermediate transfer body, when fixing a toner image at the second speed to a transfer material whose length is greater than the distance between the intermediate transfer body and the fixing unit, in an apparatus which collectively transfers toner images formed sequentially on an image holding body to a transfer material by transferring them to an intermediate transfer body so that they are overlaid, and then fixes the images to the transfer material by a fixing unit.

In the apparatus disclosed by Jpn. Pat. Appln. KOKAI Publication No. 2000-267474, the pressure contact between the intermediate transfer body and image holding body decreases the speed of the fixing unit.

However, in a method of releasing the pressure contact between the intermediate transfer body and image holding body, overlaid toner images which should be transferred from the image holding body to the intermediate body remain on the image holding body, or the overlaid toner images collapse on the intermediate transfer body, degrading the picture quality. Particularly, in a color image, when part of the toner is insufficient and the toner layer thickness changes, color reproduction becomes inexact.

To decrease the speed of the fixing unit without releasing the contact pressure between the intermediate transfer body and image holding body, it is necessary to make the distance between the fixing unit and the transfer position for transferring a toner image from the intermediate transfer body to a transfer material of a transfer material, greater than the maximum length capable of accommodating an image. This increases the size of an image forming apparatus.

When the fixing speed is increased, it is inevitable to set an upper limit taking into account the maximum value of power applicable to the image forming apparatus in view of the passivity of fire (overheating) if a paper jam should occur in the fixing unit.

BRIEF SUMMARY OF THE INVENTION

It is an object of the present invention to provide an image forming apparatus, which can reproduce colors exactly and output a color image with minimized degradation of picture quality.

According to an aspect of the present invention, there is provided an image forming apparatus comprising:

a developer image holding member which receives developer images developed by supplying a developer to electrostatic latent images formed on a photoconductor, at a first position;

a transfer unit which transfers the developer images held by the developer holding member to a transfer medium supplied between the developer image holding member and transfer unit itself, when being positioned at second position at a predetermined timing and the transfer unit capable of positioned at a third position not contacting the developer image holding mechanism;

a fixing unit which fixes the developer images to the transfer medium with heat and pressure; and a driving unit which moves the optional positions of the developer holding member, transfer unit and fixing unit at respective predetermined speeds each of, and changes each of the predetermined speed based on the kind and thickness of the transfer medium.

According to another aspect of the present invention, there is provided a method of fixing by transferring superimposed developer images to a transfer medium in the state that two or more developer images are laid on, and fixing developer images to a transfer medium by increasing an effective fixing temperature, comprising:

reducing the speed of moving the circumference of a photoconductor, the speed of moving the surface of a transfer belt, and the speed of moving the circumference of a fixing unit to predetermined speeds, respectively, corresponding to the thickness and material of a transfer medium, in a period from a moment when a part of a transfer belt corresponding to the rear end of the last one of developer images overlaid and transferred primarily passes a primary transfer position where a photoconductor contacts a transfer belt, to a moment when a part of a transfer belt corresponding to the front end of the primarily transferred developer image reaches the primary transfer position in the next rotation of the transfer belt.

According to still another aspect of the present invention, there is provided an image forming apparatus comprising:

a photoconductor which holds an electrostatic latent image;

a first developing unit which forms a first developer image in the photoconductor by developing a first electrostatic latent image formed on the photoconductor by supplying a first color developer;

a second developing unit which forms a second developer image in the photoconductor by developing a second electrostatic latent image formed on the photoconductor by supplying a second color developer;

an intermediate transfer member which holds the first and second developer images formed on the photoconductor;

a transfer unit which transfers the first and second developer images the intermediate transfer member to a transfer medium;

a fixing unit which fixes the first and second developer images transferred to the transfer medium by the transfer unit, to the transfer medium by heating; and a control unit which decreases the speed of the fixing unit, in a period from a moment when a part of the intermediate transfer member corresponding to the rear end of the second developer image the intermediate transfer member passes a primary transfer position where the intermediate transfer body contacts the photoconductor, to a moment when a part of the intermediate transfer member corresponding to the front end of the developer image transferred at the reaches first the primary transfer position in the overlaid state.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Hereinafter, embodiments of the present invention will be explained with reference to the accompanying drawings.

Figure 1:
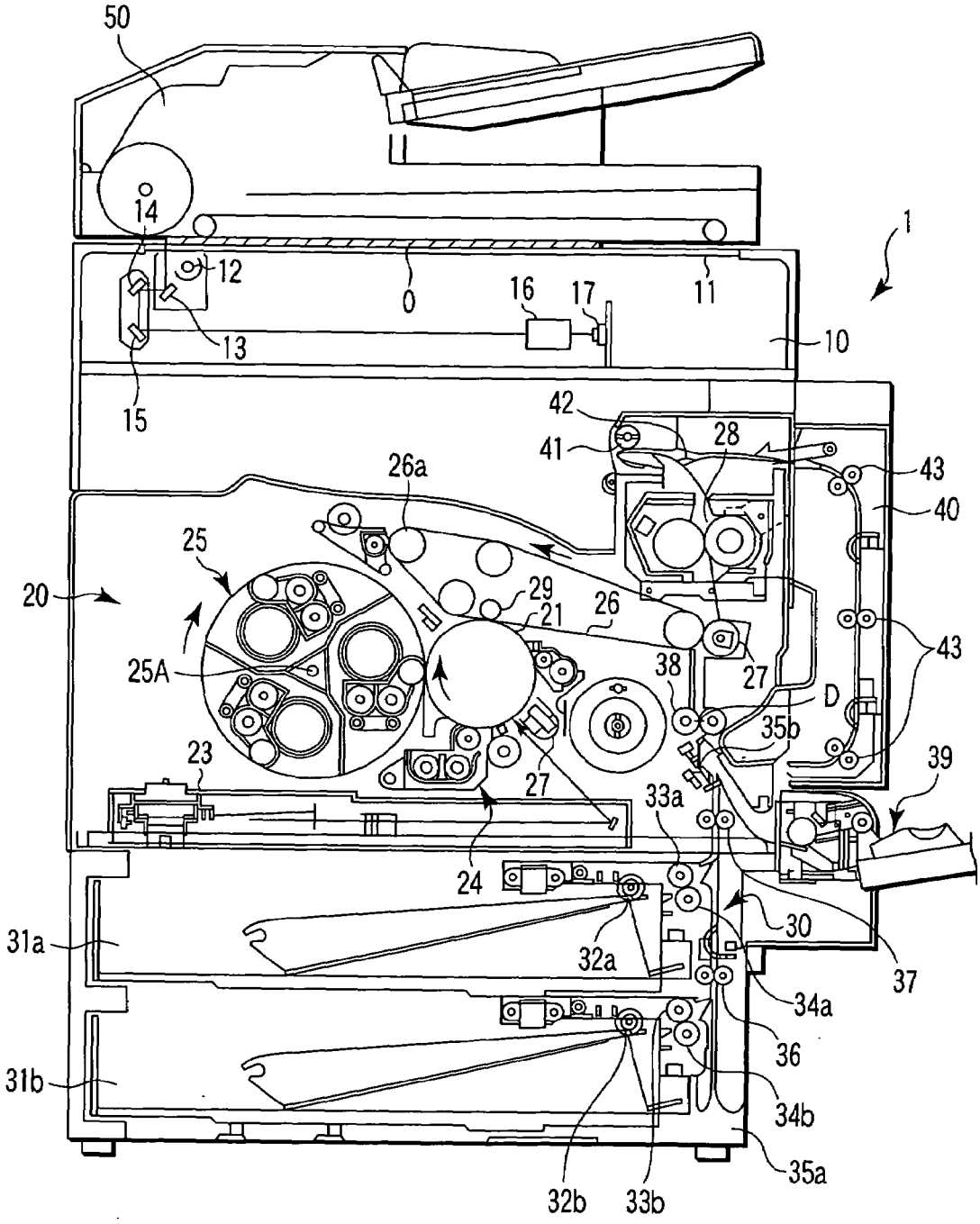
FIG. 1 is a schematic diagram showing an example of an image forming apparatus according to an embodiment of the present invention.

FIG. 1 is a schematic drawing showing an example of an image forming apparatus according to an embodiment of the present invention.

As shown in FIG. 1, an image forming apparatus 1 has an image reader 10, an image forming unit 20, a sheet material supply unit 30, and an automatic document feeder (ADF) 50.

The image reader 10 captures the image information of a copying (reading) object as light and shade, and outputs a signal corresponding to the image information or image data. The image forming unit 20 forms a copying image or output image based on the image data generated by the image reader 10. The sheet material supply unit 30 supplies an output medium to the image forming unit 20. The automatic document feeder (ADF) 50 which replaces a copying object each time the image reader 10 generates image data and the image forming unit outputs an image, when a copying object is a sheet.

The image reader 10 includes an original table 11, an illumination unit 12, first to third mirrors 13, 14 and 15, a lens 16, and a CCD sensor 17.

The original table 11 holds a not-shown copying (reading) object. The illumination unit 12 illuminates the object set on the original table 11. The first to third mirrors 13, 14 and 15 guide a reflected light or image light from the object illuminated by the illumination unit 12. The lens 16 which gives a predetermined image forming magnification to the image light guided by the mirrors 13–15. The CCD sensor 17 receives the image light with the predetermined image forming magnification given by the lens 16, and outputs image data corresponding to the image light.

The image forming unit 20 includes a photoconductor 21, a main charging unit 22, an exposing unit 23, a black (first) developing unit 24, a color (second) developing unit in the predetermined order, an intermediate transfer body (transfer belt) 26, a transfer unit 27, and a fixing unit 28.

The photoconductor 21 holds an electrostatic latent image that is generated by irradiating light in the previously charged state. The main charging unit 22 gives a predetermined surface potential to the photoconductor 21. The exposing unit 23 emits light with the intensity distribution corresponding to the image data to the photoconductor 21 having a predetermined surface potential give by the main charging unit 22. The black (first) developing unit 24 supplies black (Bk) toner selectively to the latent image formed on the photoconductor 21. The color (second) developing unit supplies C (cyan), M (magenta) and Y (yellow) toner selectively to the electrostatic latent image formed on the photoconductor 21 in the predetermined order. The intermediate transfer body (transfer belt) 26 hold the Bk, C, M and Y toner images formed on the photoconductor 21 in the overlaid state. The transfer unit 27 transfers the color toner image laid on the transfer belt 26 to an output medium. The fixing unit 28 which fixes the color toner image transferred to the output medium to the output medium. The photoconductor 21 is cylindrical (drum) in the embodiment of the present invention, and is called a photoconductor drum hereinafter. Various media are usable as an output medium, including a sheet material sheet of 50–250 g/m$^2$ thick, transparent resin sheet, and adhesive coated seal.

At a position where the photoconductor drum 21 contacts the intermediate transfer body 26, an intermediate transfer unit 29 is provided to transfer the toner images formed on the photoconductor drum 21 inside the intermediate transfer body 26, sequentially to the transfer belt 26.

The sheet material supply unit 30 is provided with a sheet material holder 35*a* which includes first and second slots 31*a*, 31*b* which fit with cassettes containing optional size sheet material (output medium), first and second pickup rollers 32*a*, 32*b* which feed the sheet material contained in the cassettes toward a sheet material conveying path explained later, first and second sheet material supplying rollers 33*a*, 33*b* which separate the sheet material sheets fed by the first and second pickup rollers 32*a* and 32*b* by the friction difference between the sheet material sheets and between the sheet material sheet and the roller, and separating rollers 34*a*, 34*b* which contact the sheet material supply rollers; and a sheet material conveying unit 35*b* which supplies the sheet material sheet fed from an optional cassette toward the image forming unit 20.

The sheet material conveying unit 35*b* is provided with a first intermediate conveying roller 36 which conveys the sheet material contained in the cassette set in the slot located at the position far from the image forming unit 20 toward the image forming unit 20, a second intermediate conveying roller 37 which conveys the sheet material toward the image forming unit 20 between the first intermediate conveying roller 36 and image forming unit 20, and an aligning roller 38 which stops temporarily the sheet material on the upstream side of the transfer unit 26, and aligns the positions of the color toner image and sheet material laid on the intermediate transfer body 25.

The sheet material conveying unit 35*b* is also provided with a manual feeding unit 39 usable for supplying a predetermined number of sheet material and OHP sheets, and connection unit which can guide the sheet material and OHP sheets set in the manual feeding unit 39 toward the aligning roller 38.

In the downstream of the fixing unit 28, there is provided a reversing unit 40 which can eject an output medium with a color toner image fixed by the fixing unit 28 to a copy tray or space between the image reader 10 and image forming unit 20, and reverses the front and back of the output medium (sheet material) with a color toner image fixed already to one side.

The reversing unit 40 outputs a sheet material sheet (output medium) for which no more image is formed (the image forming and fixing are completed) to the copy tray, and is provided with an ejecting/reversing roller 41 which guides the sheet material sheet instructed to reverse the front and back (double-side copying), a switching unit 42 which guides the sheet material sheet fed from the ejecting/reversing roller 41 toward the reversing unit 40, and conveying rollers 43, . . . , 43 which convey the sheet material sheet supplied to the reversing unit 40 toward the aligning roller 38.

In the image forming apparatus 1 shown in FIG. 1, when a copying object (hereinafter, called an original) is set on the original table 11 by ADF 50 or directly and start of copying is instructed from an operation panel 151 (refer to FIG. 2), the illumination unit 12 emits light at a predetermined timing and illuminates an original O. Then, a reflected light which includes the image information of the original as light and shade is taken out. Hereinafter, this reflected light is called an image light.

The image light is guided to the lens 16 through the first to third mirrors 13–15, where a predetermined image forming magnification is given, and applied to the CCD sensor 17 to form an image.

Figure 2:
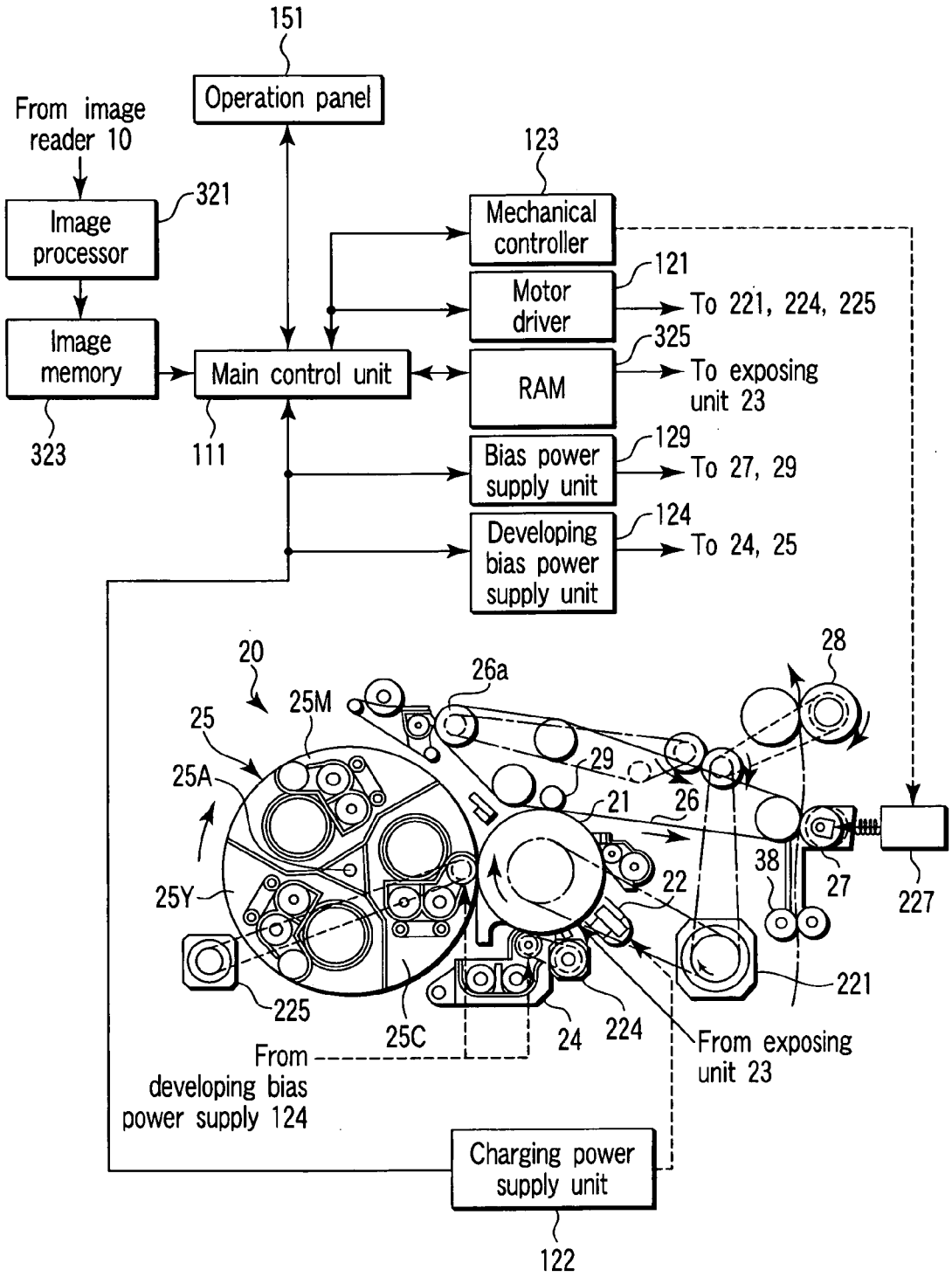
FIG. 2 is a schematic diagram explaining an example of a control system of the color image forming apparatus explained in FIG. 1.
Figure 3:
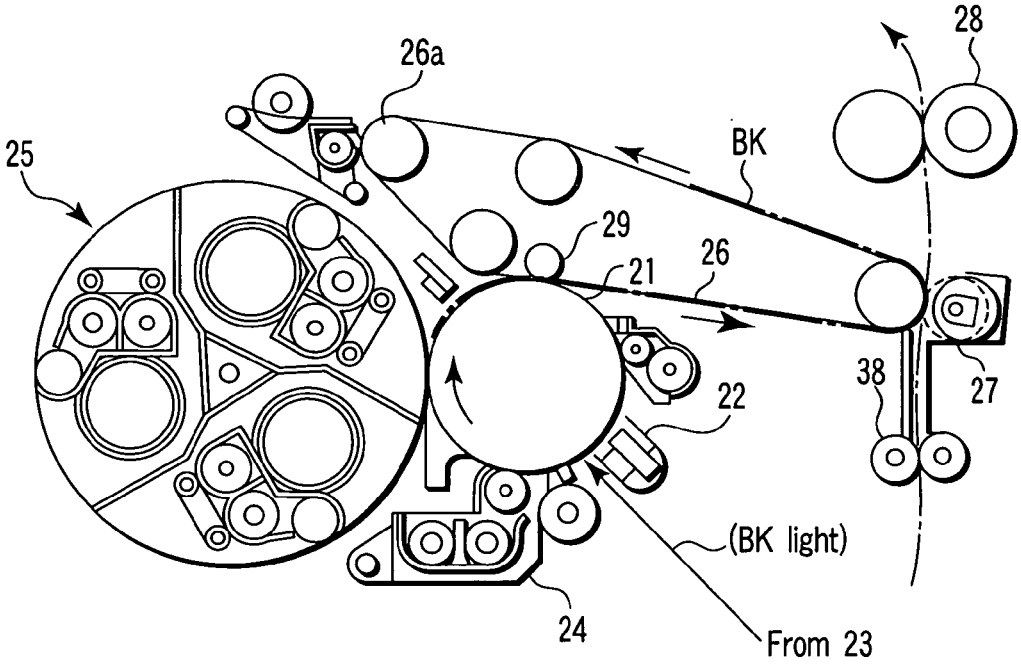
FIG. 3 is a schematic diagram explaining formation and intermediate transfer of a first toner image in the color image forming apparatus shown in FIG. 1.

The image light applied to the CCD sensor 17 is converted photoelectrically by the CCD sensor, and converted to image data in an image processor 312 (refer to FIG. 2), and stored in an image memory 323 (refer to FIG. 2).

At a predetermined timing based on the star of illuminating the original by the illumination unit 12, the charging unit 22 gives a predetermined potential to the surface of the photoconductor drum 21.

When the image light with the intensity changed based on the image data is radiated from the exposing unit 23, the surface potential of the photoconductor drum 21 given a predetermined surface potential by the charging unit 22 is changed selectively. The potential difference on the photoconductor drum 21 is the photoconductor drum 21 as an electrostatic latent image for predetermined duration.

When the electrostatic latent image the photoconductor drum 21 is a latent image corresponding to black (Bk), the image is developed and visualized by the black toner supplied from the Bk developing unit 24.

When the electrostatic latent image the photoconductor drum 21 is a latent image corresponding to an optional color component image other than black, the image is visualized by a predetermined color toner supplied from a developing unit of a color developing unit 25 having the corresponding color toner. For example, the color developing unit 25 is of the revolver type in which three developing units (25C, 25M, 25Y) containing the toner which can visualize three color components separated based on the well-known subtractive color mixing are formed rotatable around the rotation axis 25A.

The toner (monochrome) image formed on the photoconductor drum 21 is conveyed to the intermediate transfer position contacting the transfer belt 26 by the rotation of the photoconductor drum 21, and transferred from the inside of the transfer belt 26 to the transfer belt 26 by a predetermined transfer bias voltage supplied from the intermediate transfer unit 29. When the required image output (hardcopy) is color, C toner image, M toner image and Y toner image are transferred sequentially to the Bk toner image that is formed by the black developing unit 24.

When the four color toner images are transferred and laid on the transfer belt 26, the output medium (sheet material or OHP sheet) guided to the aligning roller 38 at a predetermined timing is conveyed to the transfer position where the transfer belt 26 contacts the transfer unit 27, and all toner image or a color toner image are transferred to the output medium by the output transfer bias voltage supplied from the transfer unit 27. The transfer unit 27 can be contacted or cannot be contacted to the transfer belt 26 by the interval holding mechanism 227. In the non-transfer state, the transfer unit is located at the safety. position with a predetermined interval taken to the transfer belt 26, to prevent drawing back of the toner image laid on the transfer belt 26.

The toner image or color toner image transferred to the output medium such as sheet material or OHP sheet is guided to the fixing unit 28 when the output medium is conveyed.

The toner image guided to the fixing unit 28 is heated and fused with the output medium by the heat from the fixing unit 28, and fixed to the output medium by a predetermined pressure.

The sheet material (output medium) is taken out one by one from the cassette or the manual feeding unit 39 fit in the first or second slot 31*a* or 31*b*, and conveyed previously to the aligning roller 38.

The sheet material conveyed to the aligning roller 38 is being butted by the aligning roller 38 whose rotation is stopped, whereby a non-parallel component or inclination against the conveying direction that may occur when the sheet material is fed from the sheet material holder 35*a* or while being conveyed on the sheet material conveying path 35*b* is eliminated, and the sheet material is once stopped.

In the color image forming apparatus shown in FIG. 1, the whole toner layer becomes thick because black toner image, Y toner image, M toner image and C toner image are overlaid. Thus, it is useful to reduce the fixing speed and increase the effective value of the fixing temperature for fixing all the overlaid toner securely to the output medium without increasing the fixing temperature undesirably.

FIG. 2 is a schematic diagram explaining an example of a control system of the color image forming apparatus explained in FIG. 1.

An original is set on the original table 11, start of copying is instructed from the operation panel 151, and image data corresponding to the original image is obtained in the image reader 10.

The image data is processed by an image processor 321 according to the predetermined image processing routine, and stored in the image memory 323.

In the image forming unit 20 and sheet material supply unit 30, the motor 221 which rotates the rotation center 21*a* of the photoconductor drum 21 and the driving axis 26*a* of the transfer belt 26 in a predetermined direction under the control of a main control unit 111 is rotated at a predetermined timing corresponding to the start of reading the original image by the image reader 10. The motor 221 is used also to drive a heating roller or heating belt not described in details of the fixing unit 28, and to rotate the roller body not described in detail of the transfer unit 27. As another example, it is also possible to rotate the roller of the sheet material supply unit 30 by the motor 221.

The motor 221 is rotated at a predetermined speed by the input of predetermined number of motor driving pulses from the main control unit 111 to the motor driver 121. The rotation of the motor 221 is transmitted through a not-shown transmission mechanism to the rotation center 21*a* of the photoconductor drum 21 and the driving axis 26 of the transfer belt 26. Thus, an optional position on the circumference of the photoconductive drum 21 and an optional position on the circumference of the transfer belt 26 are moved at the same speed.

Predetermined voltage and current are supplied from the charging power supply unit 122 to the charging unit 22 at a predetermined timing corresponding to the rotation start of the motor 221, and the charging unit 22 gives a predetermined surface potential to the photoconductor drum 21.

A developing bias voltage of predetermined value and polarity is supplied from a developing bias power supply 124 to the developing roller of the black developing unit 24 at a predetermined timing corresponding to the start of charging the photoconductor drum 21 by the charging unit 22. At the same time, or at a predetermined timing, a black developing motor 224 is rotated, and the developing roller of the black developing unit 24 is rotated. The black developing unit 24 is located by a not-shown black developing position control mechanism, for example, at the black developing position where a predetermined interval is taken between the surfaces of the photoconductor drum 21 and developing roller, taking the rotation center 24*a* as a rotation axis.

Thereafter, the black image data stored in the image memory 323 is converted to an exposing (serial) data for forming an electrostatic latent image on the photoconductor drum 21, and supplied to the exposing unit 23, at a predetermined timing (exposure timing) defined based on a not-shown marker or the like provided at an optional position on the surface or rear side (inside) of the transfer belt 26, for example.

For the conversion from image data to serial data, a well-known method is used, for example, development to a page memory (RAM) 325 which holds the storage capacity equivalent to one page of image output, and transmission of developed parallel data 1-line by 1-line to the exposing unit 23.

According to the black (Bk) image light radiated from the exposing unit 23 to the photoconductor drum 21, an electrostatic image (electrostatic latent image) of a black image is formed on the photoconductor drum 21. The black electrostatic latent image is developed by the black developing unit 24, and a black (Bk) toner image is formed on the photoconductor drum 21.

After a predetermined time passes (end of exposing a black image) after the black image data held temporarily in the RAM 325 is transferred to the exposing unit 23, the black developing unit 24 is moved from the black developing position to a predetermined safe position according to the instruction (control command) from the main control unit 111. Supply of the developing bias voltage by the developing bias power supply 124 and rotation of the developing roller by the black developing motor 224 are stopped at a predetermined timing.

The black toner image formed on the photoconductor drum 21 is guided to the intermediate transfer position contacting the transfer belt 26 by the rotation of the photoconductor drum 21.

The black toner image guided to the intermediate transfer position is brought into contact with the transfer belt 26 in the transfer belt 26, and transferred (drawn) to the transfer belt 26 by the transfer electric field from the intermediate transfer unit 29 which is given a black intermediate transfer bias voltage Vtbk of predetermined value and polarity.

The black toner image transferred to the transfer belt 26 is sequentially moved as the surface of the transfer belt 26 moves, or the driving axis 26*a* rotates. The transfer unit 27 can be located at either the transfer position pressed to the circumference of the transfer belt 26, or the non-transfer position not contacting the transfer belt 26, when a pressing mechanism 227 which presses/separates a roller body to/from the transfer belt 26 is operated by the mechanical controller 123. In this case, the transfer unit is saved at the non-contacting position. Therefore, the black toner image is conveyed again toward the intermediate transfer position, when the surface of the transfer belt 26 is moved (rotated).

After the black toner image is transferred to the transfer belt 26, the toner not transferred to the transfer belt 26 is eliminated from the surface of the photoconductor drum 21 by a drum cleaner not described in detail, and the drum surface is restored (reset) by a discharging unit not described in detail to the potential distribution before a predetermined potential was given by the charging unit 22.

Figure 4:
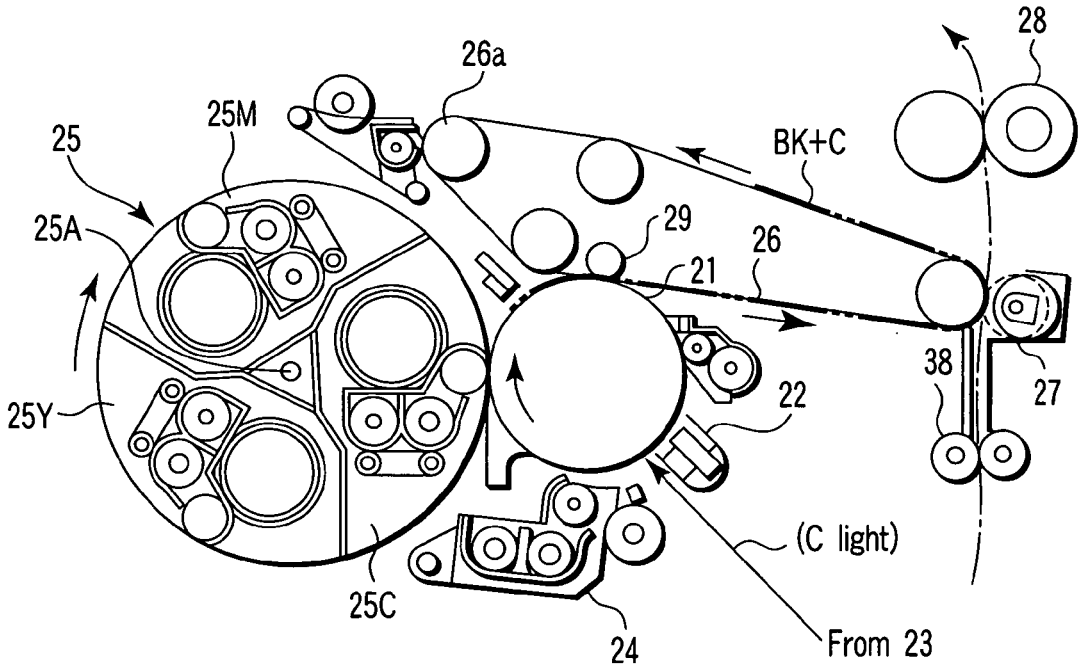
FIG. 4 is a schematic diagram explaining formation and intermediate transfer of a second toner image subsequent to the formation and intermediate transfer of the first toner image shown in FIG. 3.

Then, as shown in FIG. 4, according to the color image forming instruction from the main control unit 111, by the transmission of the driving force from the motor 221 by the rotation of the not-shown color developing unit rotating motor or through a not-shown transmission mechanism, the developing roller of an optional developing unit of the color developing unit 25 is located at the color developing position opposite to the predetermined position on the circumference of the photoconductor drum 21.

For example, when an image to be laid on a black toner image is a C (cyan) image, the color developing unit 25 is rotated around the center axis 25*a* in the counterclockwise direction (arrow direction) until the developing roller of the cyan (C) developing unit 25C of the color developing unit 25 is faced to the photoconductor drum 21. Then, the charging power supply unit 122 supplies a predetermined voltage and current to the charging unit 22, and the photoconductor drum 21 is charged again to a predetermined surface potential.

At a predetermined timing corresponding to the start of charging the photoconductor drum 21 by the charging unit 22, the developing bias power supply 124 supplies a developing bias voltage of predetermined value and polarity to the developing roller of the cyan (C) developing unit 25C. At the same time, or at a predetermined timing, a color developing motor 225 is rotated, and the developing roller of the cyan (C) developing unit 25C is rotated.

Next, the C (cyan) image data stored in the image memory 323 based on the exposure timing defined based on the going-around of the transfer belt 26 is converted by the RAM 325 to an exposing (serial) data for forming an electrostatic latent image on the photoconductor drum 21, and supplied to the exposing unit 23.

Thus, an electrostatic latent image of the cyan (C) image is formed on the photoconductor drum 21, corresponding to the C image light irradiated from the exposing unit 23 to the photoconductor drum 21. The cyan (C) electrostatic latent image is developed by the C developing unit 25C. Namely, a cyan toner image is formed on the photoconductor drum 21.

As the black toner image has been transferred to the transfer belt 26, the cyan image is exposed to the photoconductor drum 21 at a predetermined timing set to lay on the black toner image formed already on the transfer belt 26.

As the photoconductor drum 21 rotates, the cyan toner image formed on the photoconductor drum 21 is conveyed to the intermediate transfer position contacting the transfer belt 26, and laid on the black toner image. In this time, a bias power supply unit 129 supplies the intermediate transfer unit 29 with a cyan intermediate transfer bias voltage Vtc whose absolute value is larger than the black intermediate transfer bias voltage Vtbk.

Thus, the cyan toner image is laid on and transferred to the black toner image on the transfer belt 26 without drawing back the black toner image transferred already to the transfer belt 26 by the photoconductor drum 21.

As the photoconductor drum 21 rotates, the cyan toner image is sequentially conveyed together with the black toner image as the surface of the belt 26 moves. As the transfer unit 27 is saved at the non-transfer position, the cyan toner image and black toner image are conveyed again toward the intermediate transfer position.

After the cyan toner image is transferred to the transfer belt 26, the toner not transferred to the transfer belt 26 is eliminated from the surface of the photoconductor drum 21, and the drum surface is restored to the potential distribution before a predetermined potential was given by the charging unit 22.

Figure 5:
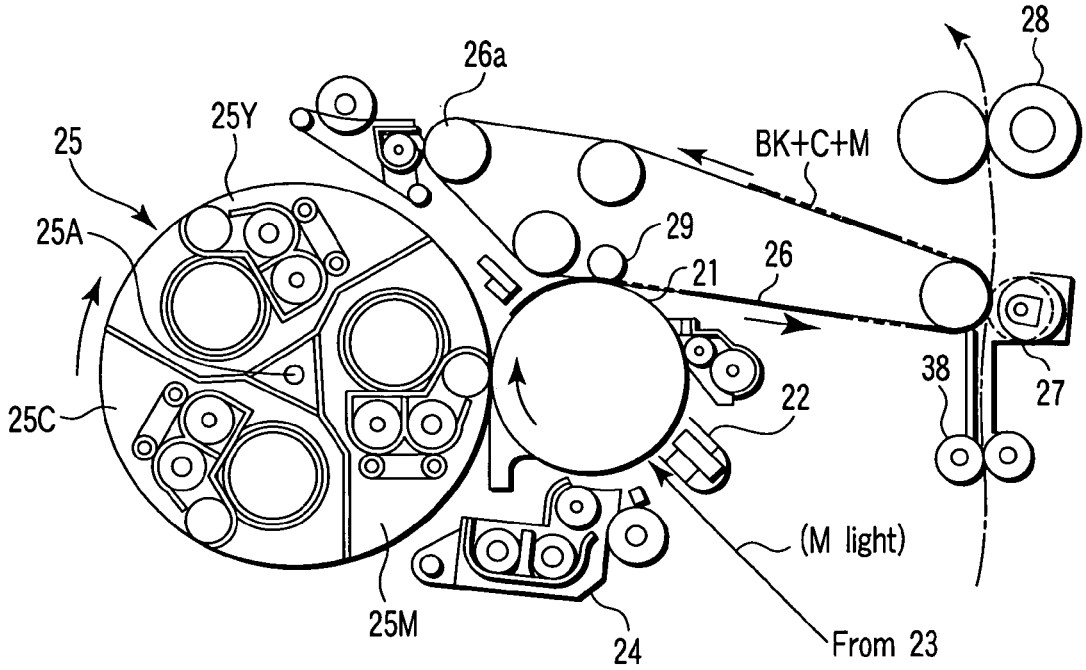
FIG. 5 is a schematic diagram explaining formation and intermediate transfer of a third toner image subsequent to the formation and intermediate transfer of the second toner image shown in FIG. 4.

As shown in FIG. 5, the color developing unit 25 rotates around the center axis 25*a* in the arrow direction, for example, until the developing roller of the magenta (M) developing unit 25M of the color developing unit 25 faces to the photoconductor drum 21.

Then, the charging power supply unit 122 supplies predetermined voltage and current to the charging unit 22, and the photoconductor drum 21 is charged again to a predetermined surface potential.

At a predetermined timing corresponding to the start of charging the photoconductor drum 21 by the charging unit 22, the developing bias power supply 124 supplies the developing roller of the magenta developing unit 25M with a developing bias voltage of predetermined value and polarity. At the same time, or at a predetermined timing, the color developing motor 225 is rotated, and the developing roller of the magenta developing unit 25M is rotated.

Next, according to the exposure timing defined based on the round of rotation of the transfer belt 26, the M (Magenta) image data stored in the image memory 323 is converted by the RAM 325 to an exposing (serial) data for forming an electrostatic latent image on the photoconductor drum 21, and supplied to the exposing unit 23.

Thus, an electrostatic latent image of the magenta (M) image is formed on the photoconductor drum 21, corresponding to the M image light irradiated from the exposing unit 23 to the photoconductor drum 21. The magenta (M) electrostatic latent image is developed by the M developing unit 25M. Namely, a magenta (M) toner image is formed on the photoconductor drum 21. As the black toner image and C toner image laid on and transferred to the black toner image have been the transfer belt 26, the latent image of M image is exposed on the photoconductor drum 21 at a predetermined timing set to overlay the M toner image on the both toner images formed already on the transfer belt.

As the photoconductor drum 21 rotates, the M toner image formed on the photoconductor drum 21 is conveyed to the intermediate transfer position, and laid on the black toner image and C toner image laid on and transferred to the black toner image.

In this time, a bias power supply unit 129 supplies the intermediate transfer unit 29 with a magenta intermediate transfer bias voltage Vtm whose absolute value is larger than the C intermediate transfer bias voltage Vtc.

Thus, the M toner image is laid on and transferred to the black toner image and C toner image on the transfer belt 26 without drawing back the black toner image transferred already to the transfer belt 26 and C toner image laid on the black toner image by the photoconductor drum 21.

Thereafter, as the surface of the transfer belt 26 moves, the M toner image transferred to the transfer belt 26 is conveyed toward the intermediate transfer position together with the black toner image and C toner image.

After the magenta toner image is transferred to the transfer belt 26, the M toner not transferred to the transfer belt 26 is eliminated from the surface of the photoconductor drum 21, and the drum surface is restored to the potential distribution before a predetermined potential was given by the charging unit 22.

Figure 6:
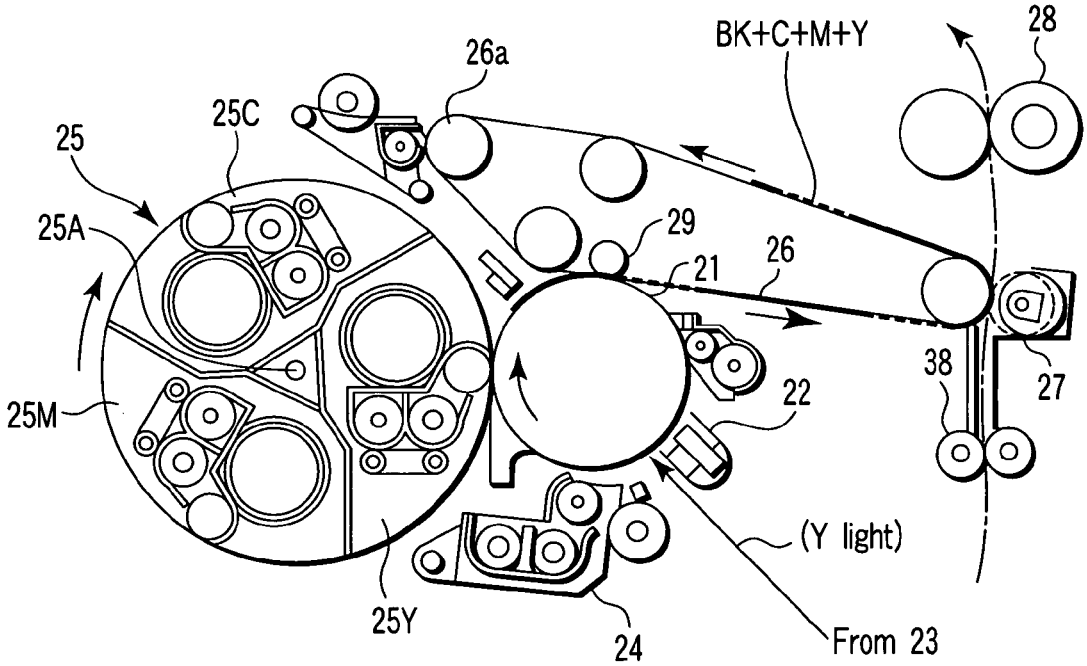
FIG. 6 is a schematic diagram explaining formation and intermediate transfer of a fourth toner image subsequent to the formation and intermediate transfer of the third toner image shown in FIG. 5.

As shown in FIG. 6, the color developing unit 25 rotates around the center axis 25*a* until the developing roller of a yellow developing unit 25Y faces to the photoconductor drum 21, so that the remaining color or Y toner image can be formed.

Then, the charging power supply unit 122 supplies predetermined voltage and current to the charging unit 22, and the photoconductor drum 21 is charged again to a predetermined surface potential.

At a predetermined timing corresponding to the start of charging the photoconductor drum 21 by the charging unit 22, the developing bias power supply 124 supplies the developing roller of the yellow (Y) developing unit 25Y with a developing bias voltage of predetermined value and polarity. At the same time, or at a predetermined timing, the color developing motor 225 is rotated, and the developing roller of the Y (yellow) developing unit 25Y is rotated.

At the exposure timing defined based on the round of rotation of the transfer belt 26, the Y image data stored in the image memory 323 is converted by the RAM 325 to an exposing (serial) data for forming an electrostatic latent image on the photoconductor drum 21, and supplied to the exposing unit 23.

Thus, an electrostatic latent image of the yellow (Y) image is formed on the photoconductor drum 21, corresponding to the Y image light irradiated from the exposing unit 23 to the photoconductor drum 21.

The yellow (Y) electrostatic latent image is developed by the Y developing unit 25Y. Namely, a yellow (Y) toner image is formed on the photoconductor drum 21. As the black toner image, C toner image laid on and transferred to the black toner image, and the M toner image laid on the both toner images have been the transfer belt 26, the latent image of Y image is exposed to the photoconductor drum 21 at a predetermined timing set to overlay the Y toner image on the above three toner images. The Y image latent image is exposed on the photoconductor drum 21 in this way.

As the photoconductor drum 21 rotates, the Y toner image formed on the photoconductor drum 21 is conveyed to the intermediate transfer position, and laid on the black toner image, C toner image laid on and transferred to the black toner image, and M toner image laid on the above both toner images.

In this time, a bias power supply unit 129 supplies the intermediate transfer unit 29 with a yellow intermediate transfer bias voltage Vty whose absolute value is larger than the M intermediate transfer bias voltage Vtm.

Thus, the Y toner image is transferred to the transfer belt 26 (having the Bk (black), C (cyan) and M (magenta) toner images transferred already) without drawing back the black toner image, C toner image and M toner image, or one of them, transferred already to the transfer belt 26 by the photoconductor drum 21.

Thereafter, as the surface of the transfer belt 26 moves, the Y toner image transferred to the transfer belt 26 is conveyed toward the intermediate transfer position together with the black toner image, C toner image and M toner image.

After the Y toner image is transferred to the transfer belt 26, the Y toner not transferred to the transfer belt 26 is eliminated from the surface of the photoconductor drum 21, and the drum surface is restored to the potential distribution before a predetermined potential was given by the charging unit 22.

In this way, a color toner image corresponding to the image data read by the image reader 10 and stored in the image memory 323 is formed on the transfer belt 26.

As explained with reference to FIGS. 3 to 6, a color toner image is in the state that 4 layers (colors) are laid on the transfer belt 26.

Thus, when fixing an image to an output medium that is sheet material or OHP sheet by the fixing unit 28, it is effective to increase an effective fixing temperature by decreasing the speed of a heating roller or heating belt not described in detail of the fixing unit 28.

Therefore, according to FIG. 6, it is preferable to decrease the rotational frequency of the motor 221 to ½, ⅓ or ¼, for example, by the control of the main control unit 111, at the time when a fourth color toner image is transferred to the transfer belt 26.

For example, the rotational frequency of the motor 221 or the speed of moving an optional position on the circumference of the heating roller of the fixing unit or the surface of the heating belt is set to ½ when the output medium thickness is over 105 g/m$^2$ and under 165 g/m$^2$, and ⅓ when it is over 165 g/m$^2$, respectively. For example, ¼ is set for the OHP sheet. This speed data is stored previously as firmware of the main control unit 111, for example, or in a not-shown memory built in the main control unit 111 or provided externally.

Figure 7:
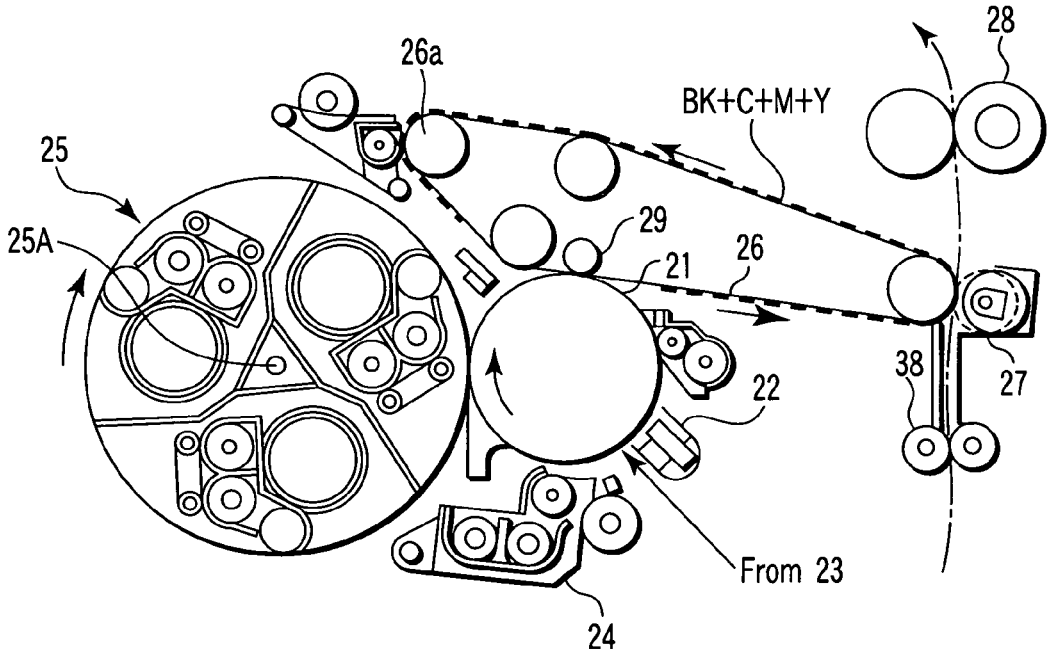
FIG. 7 is a schematic diagram explaining an example of timing for changing the motor speed to increase an effective fixing temperature, and timing for contacting a transfer unit to a transfer belt and a toner image on a transfer belt.

As shown in FIG. 7, at the time when the fourth color Y toner image is laid on and transferred to the black toner image, C toner image and M toner image transferred already on the transfer belt 26, the front end of the toner image on the transfer belt 26 in the state a color toner image or all toner images are overlaid is moved toward the intermediate transfer position passing the transfer position where the toner image can be transferred to an output medium. At the transfer position, the transfer unit 27 is saved to prevent the four colors of toner images transferred sequentially to the transfer belt 26 from being drawn by the transfer unit 27.

Thus, when the transfer unit 27 contacts the transfer belt 26 with four colors of toner images overlaid, the toner is transferred from the transfer belt 26 to the transfer unit 27. However, when the speed of the motor 221 is changed in the state that the transfer unit 27 contacts the four colors of toner images on the transfer belt 26, the toner images on the transfer belt 26 are displaced causing a defective image, by the slight difference between the timing for changing the rotational frequency of the photo conductor drum 21 and the rotation axis of the transfer belt 26 from the motor 221, and the timing of changing the speed of the heating roller or heating belt of the fixing unit 28.

FIG. 7 explains an example of timing for changing the motor speed to increase an effective fixing temperature, and timing for contacting a transfer unit to a transfer belt and a toner image on a transfer belt.

As shown in FIG. 7, the front end of the four colors of (Bk+C+M+Y) toner images explained with reference to FIGS. 3 to 6 is guided close to the intermediate transfer unit 29 at the time when the rear end of the Y toner image is transferred to the transfer belt 26 (end of transfer), by that the surface of the transfer belt 26 is continuously moved.

Namely, when the Y (yellow) toner image is laid over and transferred to the black toner image, Cyan toner image and Magenta toner image transferred already on the transfer belt 26, it is not transferred to an output medium by the transfer unit 27 in the same round of turn, but rotated further as the surface of the transfer belt 26 is moved.

As explained already, since the transfer belt 28 and photoconductor drum 21 are contacted by the intermediate transfer unit 29 by a predetermined pressure at the intermediate transfer position, when changing the rotational frequency of the motor 221, it is necessary to change the rotational frequency to the value after the change, before the four colors of toner images on the transfer belt 26 are moved to the intermediate transfer position. As a condition to change the rotational frequency, it is necessary to move the four colors of toner images formed on the transfer belt 24 from the above-mentioned intermediate transfer position to the transfer unit.

Therefore, considering the movement of the surface of the transfer belt 26 to be a position of a toner image, it is necessary to set a section where the speed of the transfer belt and photoconductor drum 21 or the rotational frequency of the motor 221 can be decreased, in a period from the time when the belt surface on which the rear end of maximum four colors (Bk+C+M+Y) of toner images formable on the transfer belt 26 is located is moved to the transfer position passing the intermediate transfer position, to the time when the belt surface on which the front end of the four colors of toner images is located arrives again at the intermediate transfer position as the transfer belt 26 rotates a round.

It is also necessary to decrease the rotational frequency of the roller body not described in detail of the transfer unit 27, or the circumference moving speed, the rotational frequency (circumference moving speed) of the heating roller not described in detail of the fixing unit 28, or the speed of moving an optional position on the surface of the heating belt. But, in the present invention, as explained with reference to FIG. 2, a rotating force is given by the motor 221 to the roller body of the transfer unit 27 and the heating roller or heating belt of the fixing unit, and the detailed explanation will be omitted. However, if the roller body of the transfer unit 27 and the heating roller or heating belt of the fixing unit are give a rotating force from the other driving source than the motor 221, the rotational frequency or speed of that driving source must be set under the condition satisfying the above-mentioned section (condition).

Figure 8:
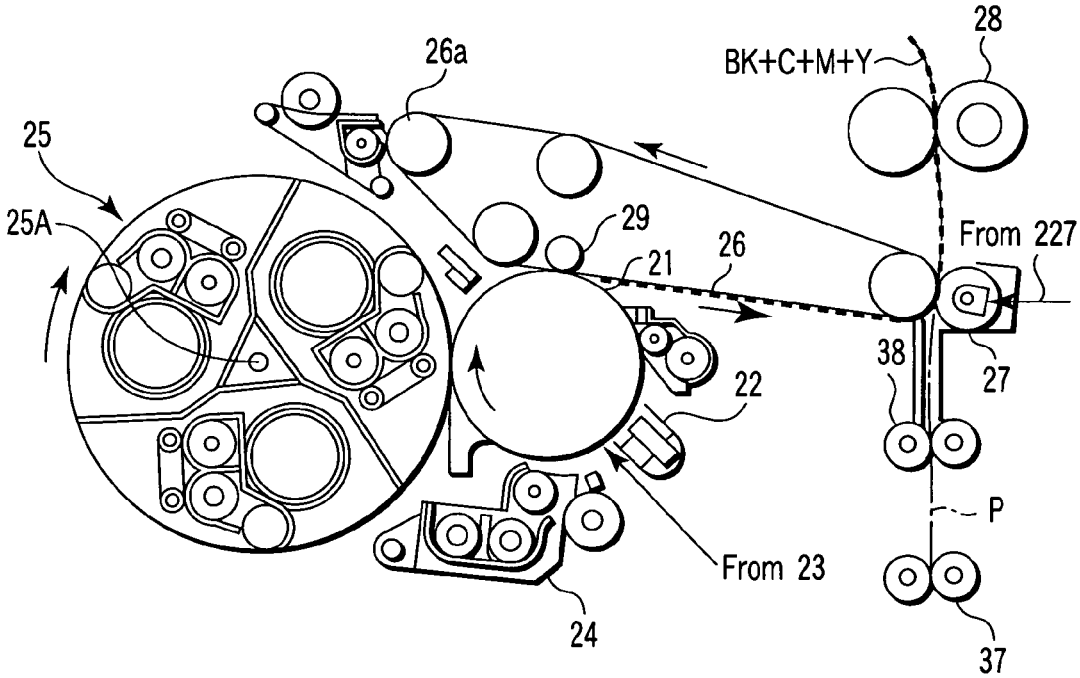
FIG. 8 is a schematic diagram explaining an example of timing for transferring the four colors of toner images laid on a transfer belt to an output medium.

Thereafter, the four colors of toner images laid on the transfer belt 26, or a color toner image is given a predetermined transfer bias voltage Vtrf from the bias power supply unit 129, as shown in FIG. 8, and transferred to an output medium P interposed between the transfer unit 27 and transfer belt 26 by the transfer unit 27 contacting the transfer belt 26 at a predetermined timing. The timing for contacting the transfer unit 27 to the transfer belt 26 must be the position on the belt surface after the belt surface on which the rear end of the four colors of toner images explained already in FIG. 6 passes the transfer position where the transfer unit 27 contacts the transfer belt 26.

As explained already by referring to FIG. 7, after the Y (yellow) toner image is transferred, the transfer belt 26 is rotated one round in the state holding the 4-layer toner image. Thus, the 4-layer toner image passes the intermediate transfer position in the state not holding a toner layer that is to be newly transferred from the photoconductor drum 21.

The value of the intermediate transfer voltage that is supplied from the bias power supply unit 129 to the intermediate transfer unit 29 is large enough to stop drawing back of the toner toward the photoconductor drum 21. Contrarily, the intermediate transfer voltage is set to a value not to be charged to the reverse polarity, as a result of accumulating the transfer voltage supplied when the toner that is already transferred to the transfer belt 26 is transferred from the photoconductor drum 21 to the transfer belt 26.

Concretely, the value of the intermediate transfer bias voltage Vt5 applied to the intermediate transfer unit 29 upon the fifth (additional one rotation for transferring the 4-layer toner image+changing the speed) is the voltage with the absolute value smaller than at least the yellow intermediate bias voltage Vty. The value of the intermediate transfer bias voltage Vt5 applied to the intermediate transfer unit 29 upon the fifth rotation of the transfer belt 26 may be the same as the previously explained cyan intermediate transfer bias voltage Vtc and magenta intermediate transfer bias voltage Vtm. The value of the intermediate transfer bias voltage Vt5 applied to the intermediate transfer unit 29 upon the fifth rotation of the transfer belt 26 in order to minimize the number of steps in the output sage of the bias power supply unit 129 may be the value to prevent the toner from returning to the photoconductor drum 21, and it may be substantially zero volt.

The intermediate transfer voltage data (multiple) is provided as firmware of the main control unit 111, for example, or built in the main control unit 111, or previously stored in a not-shown external memory.

As explained hereinafter, the four colors of toner images transferred and laid on the transfer belt 26, or a color toner image is conveyed at least 1 round of turn of the transfer belt 26 from the round that the last overlaid toner image is transferred, and transferred to an output medium by the transfer unit 27 in the next round of rotation. When the image forming condition inputted from the operation panel 151 is the condition to delay the effective fixing speed, for example, forming a color image or forming images on a sheet material sheet of a predetermined thickness or a thicker sheet material sheet, the moving speed of the circumference of the photoconductor drum 21, the moving speed of the surface of the transfer belt 26 and the moving speed of the roller or belt like heating body of the fixing unit 28 are set to the respective predetermined speeds by changing (decreasing) the rotation frequency of the motor 221 that is a source of supplying a rotational force. Therefore, the color reproducibility of a color toner image fixed to an output medium is increased, and all toner can be fixed securely to an output medium regardless of the type and thickness of an output medium. Particularly, when an output medium is a transparent resin sheet for OHP devices (medium visualizing the color of a toner image as a transmitted light), color reproducibility and color development are improved.

A color copier is taken as an example in the above-mentioned embodiments of the present invention. It is of course that a page printer and facsimile are also applicable. This invention is not to be limited to the above-mentioned embodiments. The invention may be embodied in other various forms without departing from its essential characteristics. Further, each embodiment can also be combined as far as possible. In that case, effects by combination will be obtained.

As described in detail hereinbefore, according to the present invention, when fixing a color toner image with a plurality of toner image layers to a thick transfer medium or medium of specific material, the fixing temperature can be increased effectively without increasing the heating volume of a fixing unit, and the fixing rate can be increased. Further, it is possible to obtain a color image with high color reproducibility and less degradation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a developer image holding member which receives developer images developed by supplying a developer to electrostatic latent images formed on a photoconductor, at a first position where the photoconductor and the developer image holding member contact each other;

a transfer unit which transfers the developer images held by the developer image holding member to a transfer medium supplied between the developer image holding member and the transfer unit, when being positioned at a second position where the transfer unit contacts the developer image holding member at a predetermined timing and the transfer unit capable of being positioned at a third position where the transfer unit is not in contact with the developer image holding member;

a fixing unit which fixes the developer images to the transfer medium with heat and pressure;

a driving unit which moves the optional positions of the developer holding member, the transfer unit and the fixing unit at respective predetermined speeds, and changes each of the respective predetermined speeds based on the kind and thickness of the transfer medium; and speed control units which set the speeds of the driving unit for moving the predetermined positions of the developer image holding member, the transfer member and the fixing unit, wherein the speed control unit changes the speed of moving the optional positions of the developer image holding member, the transfer unit and the fixing unit from a first speed to a second speed less than the first speed, in a period from a moment when a part of the developer image holding member corresponding to a rear end of the developer image transferred last to the developer image holding member passes the first position to a moment when a part of the developer image holding member corresponding to a front end of the developer image transferred at the first position reaches the first position;

the transfer unit is located at the third position while the speed control unit is changing the speeds of the driving unit for moving the predetermined positions of the developer holding member, the transfer unit and the fixing unit; and when a predetermined time elapses after the front end of the developer image has passed the second position, the developer image holding member holding developer images is moved from the third position to the second position.

2. The image forming apparatus according to claim 1, wherein the speed control unit sets the second speed to the lowest speed when the transfer medium has a fixed developer image with transmitted light.

3. A method of fixing by transferring superimposed developer images to a transfer medium in the state that two or more developer images are laid on, and fixing developer images to a transfer medium by increasing an effective fixing temperature, comprising:

reducing the speed of moving the circumference of a photoconductor, the speed of moving the surface of a transfer belt, and the speed of moving the circumference of a fixing unit to predetermined speeds, respectively, corresponding to the thickness and material of a transfer medium, in a period from a moment when a part of a transfer belt corresponding to the rear end of the last one of developer images overlaid and transferred primarily passes a primary transfer position where a photoconductor contacts a transfer belt, to a moment when a part of a transfer belt corresponding to the front end of the primarily transferred developer image reaches the primary transfer position in a next rotation of the transfer belt.

4. An image forming apparatus comprising:

a photoconductor which holds an electrostatic latent image;

a first developing unit which forms a first developer image in the photoconductor by developing a first electrostatic latent image formed on the photoconductor by supplying a first color developer;

a second developing unit which forms a second developer image in the photoconductor by developing a second electrostatic latent image formed on the photoconductor by supplying a second color developer;

an intermediate transfer member which holds the first and second developer images formed on the photoconductor;

a transfer unit which transfers the first and second developer images from the intermediate transfer member to a transfer medium;

a fixing unit which fixes the first and second developer images transferred to the transfer medium by the transfer unit, to the transfer medium by heating;

a control unit which decreases the speed of the fixing unit, in a period from a moment when a part of the intermediate transfer member corresponding to a rear end of the second developer image transferred by the intermediate transfer member passes a primary transfer position where the intermediate transfer body contacts the photoconductor, to a moment when a part of the intermediate transfer member corresponding to a front end of the developer image transferred by the intermediate transfer member first reaches the primary transfer position in the overlaid state; and a speed control unit which changes the speed of moving the circumference of the photoconductor, the speed of moving the surface of the intermediate transfer belt, and the speed of moving the circumference of the fixing unit to their respective predetermined speeds corresponding to the thickness and material of the transfer medium.

5. The image forming apparatus according to claim 4, wherein the speed control unit decreases the speed of moving the circumference of the photoconductor, the speed of moving the surface of the intermediate transfer body, and the speed of moving the circumference of the fixing unit corresponding to one of the thickness and material of the fixed medium, in a period from a moment when a part of the intermediate transfer body corresponding to the rear end of the second developer image passes the primary transfer position, to a moment when a part of the intermediate transfer body corresponding to the front end of the first and second developer images reaches first the primary transfer position.

6. The image forming apparatus according to claim 4, wherein the speed control unit changes the speed of moving the optional positions of the developer holding member, the transfer unit and the fixing unit from a first speed to a second speed less than the first speed, in a period from a moment when a part of the developer image holding member corresponding to the rear end of the developer image transferred last to the developer image holding member passes the primary transfer position to a moment when a part of the developer image holding member corresponding to the front end of the developer image transferred at the primary position reaches the primary position.

7. The image forming apparatus according to claim 6, wherein the speed control unit sets the second speed to the lowest speed when the transfer medium has a fixed developer image with a transmitted light.

* * * * *